United States Patent [19]

White

[11] 4,128,188

[45] Dec. 5, 1978

[54] PILL DISPENSER

[75] Inventor: Leonard A. White, Gurnee, Ill.

[73] Assignee: Baxter Travenol Laboratories, Inc., Deerfield, Ill.

[21] Appl. No.: 855,653

[22] Filed: Nov. 30, 1977

Related U.S. Application Data

[63] Continuation of Ser. No. 717,311, Aug. 24, 1976, abandoned.

[51] Int. Cl.[2] ..... B65D 83/04

[52] U.S. Cl. ..... 221/91; 221/2

[58] Field of Search ..... 221/2, 4, 5, 8, 91; 206/533, 534, 538; 215/204, 202, 206, 216, 220, 221, 223; 222/513, 516, 549, 565

[56] References Cited

U.S. PATENT DOCUMENTS

| | | | |
|---|---|---|---|
| 2,700,484 | 1/1955 | Rathsprecher | 222/549 X |
| 3,085,679 | 4/1963 | Burrell | 221/2 |
| 3,143,207 | 8/1964 | Wagner | 221/2 |
| 3,782,604 | 1/1974 | Kessler | 222/153 |

*Primary Examiner*—Stanley H. Tollberg

*Attorney, Agent, or Firm*—Paul C. Flattery; John P. Kirby, Jr.; George H. Gerstman

[57] ABSTRACT

A child-proof pill dispenser sealed against contamination is disclosed in the illustrative embodiments. The dispenser includes a pair of relatively rotatable members, which are normally prevented from rotation by axially biased teeth. A force applied against the bias disengages the teeth and permits the members to rotate. Rotation of the members opens a passage for automatic delivery of a pill. The pill is delivered from a storage compartment through an encircled passage into one of the hands required for operating the dispenser. The dispenser has a compression seal between the members for preventing contamination.

23 Claims, 11 Drawing Figures

FIG. 1
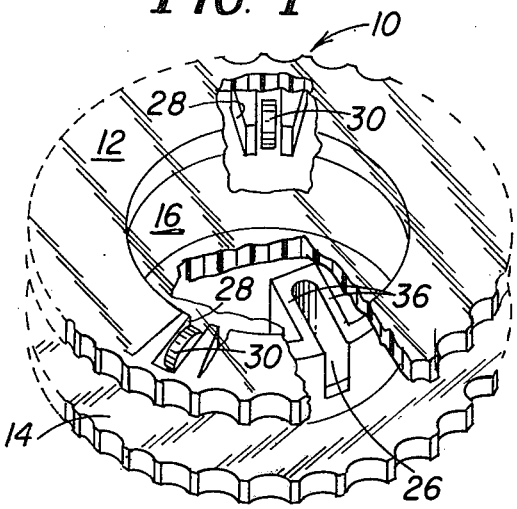
FIG. 4
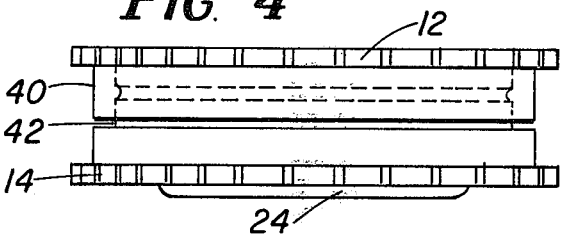
FIG. 2
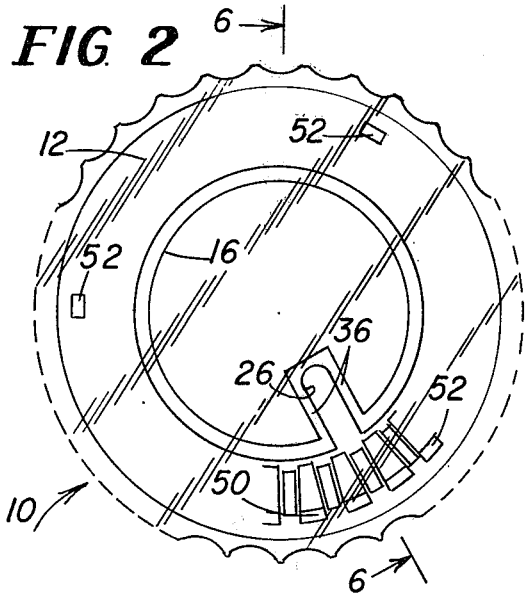
FIG. 5
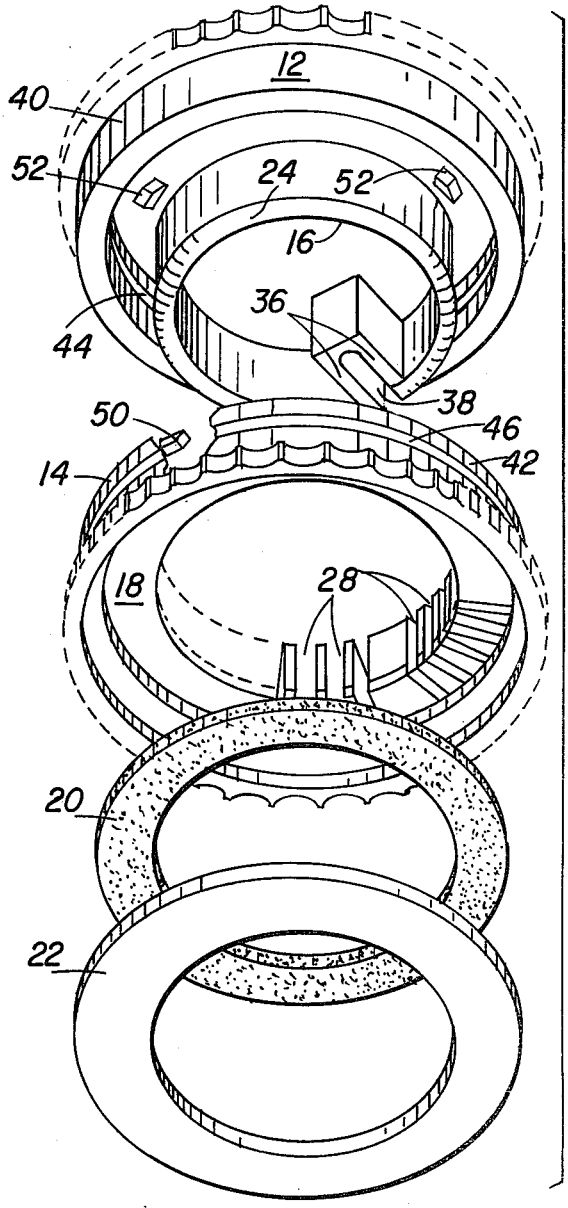
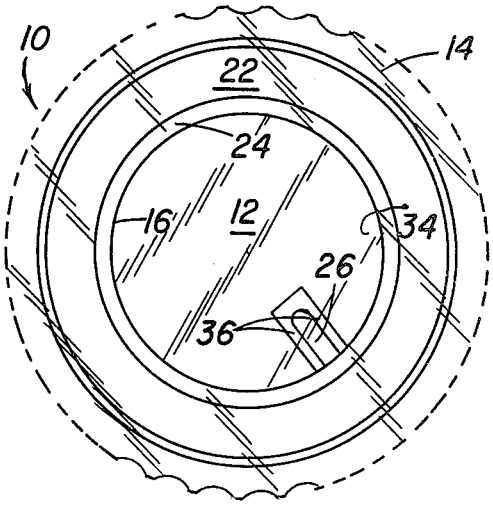
FIG. 3

PILL DISPENSER

This is a continuation of application Ser. No. 717,311, filed Aug. 24, 1976 now abandoned.

Background of the Invention

This invention relates in general to an improved pill dispenser and more particularly to a child-proof sealed pill dispenser having means for controlling the pill movement.

It is advantageous for a pill dispenser to be constructed in a manner in which children cannot easily open the container to have access to the pills. It is also advantageous for the contents of the pill dispenser to be protected against moisture contamination, particularly if the pills contain some hygroscopic material.

In one type of child-proof dispenser, an arrow on the cap or cover is rotated to align with an arrow on the container to permit the cover to be released at only one angular position from the container and a pill to be extracted. However, this would not be a satisfactory arrangement for dispensers of the type which incorporate a rotatable cover operable to different angular positions for enabling a pill to be dispensed at each angular position.

In addition, since many single dosage pills often contain hygroscopic materials, such as gelatin and/or sugars, either as binders, or the drug itself may be hygroscopic, it is appropriate that the containers be provided with a seal which retains its sealing qualities for a relatively long time period or when subject to rotary forces, or during periods of non-usage.

It is also desirable to incorporate a feature in the dispenser which permits the pill to be automatically dispensed through a confined passage into the user's hand and without the necessity of removing the cover or separate handling of the parts.

Accordingly, it is one object of the present invention to provide an improved pill dispenser.

It is another object of the present invention to provide a pill dispenser having improved child-proof features.

It is still another object of the present invention to provide a pill dispenser in which the dispenser is child-proofed in each of a plurality of different angular positions of the cover relative the container.

It is a further object of the present invention to provide a pill dispenser in which the pill is automatically dispensed in response to disengagement of the child-proofing feature and the proper angular position of the cover relative the container.

Yet another object of the present invention is the provision of an improved seal for a pill dispenser.

It is a further object of the present invention to provide a pill dispenser of economical construction.

Other objects and advantages of the invention will become apparent as the description proceeds.

SUMMARY OF THE INVENTION

In accordance with the present invention, there is provided a pill dispenser which incorporates a disc-shaped cover and ring-shaped container having engaged axially extending teeth and an axially extending chevron seal therebetween biased by a compressive member to hold the teeth and seal engaged under pressure. With pressure applied against the seal it is effective to prevent contamination. The cover and container are capable of relative axial movement therebetween against the bias of the compressive member to disengage the teeth for permitting relative rotational movement therebetween and since this operation is difficult to perform by children the dispenser is effectively child-proofed.

In one embodiment, a pill is automatically delivered into the hand of the user as the result of rotation of the cover relative to the container. The pill is held in a compartment at the periphery of the container. The compartment has a lower wall which slants downwardly toward the center of the container. Rotation of the cover aligns the pill compartment with a passage within the cover. The passage established a path between the pill compartment and an exit at the bottom of the dispenser. When the passage and compartment are aligned, the pill rolls or slides from the compartment into the passage and out the exit. Because the dispenser when operated is normally cupped within the user's hand, the exiting pill naturally falls into the user's palm.

In one embodiment, a secondary seal is also provided between the cover and container by means of a peripheral bead and recess formed on respective axially extending walls of the cover and container.

In one embodiment, the cover is secured to the container by means of a lip formed at one end of an axially extending wall and in another embodiment snapfitting fingers are formed at the wall end.

A more detailed explanation of the invention is provided in the following description and claims, and is illustrated in the accompanying drawings.

BRIEF DESCRIPTION OF THE DRAWINGS

FIG. 1 is a perspective view of a pill dispenser incorporating the principles of the present invention with a portion of the cover broken away for explanatory purposes;

FIG. 2 is a top view thereof;

FIG. 3 is a bottom view thereof;

FIG. 4 is a side elevational view thereof;

FIG. 5 is an exploded isometric view thereof;

DETAILED DESCRIPTION OF THE ILLUSTRATIVE EMBODIMENT

Figure 6:
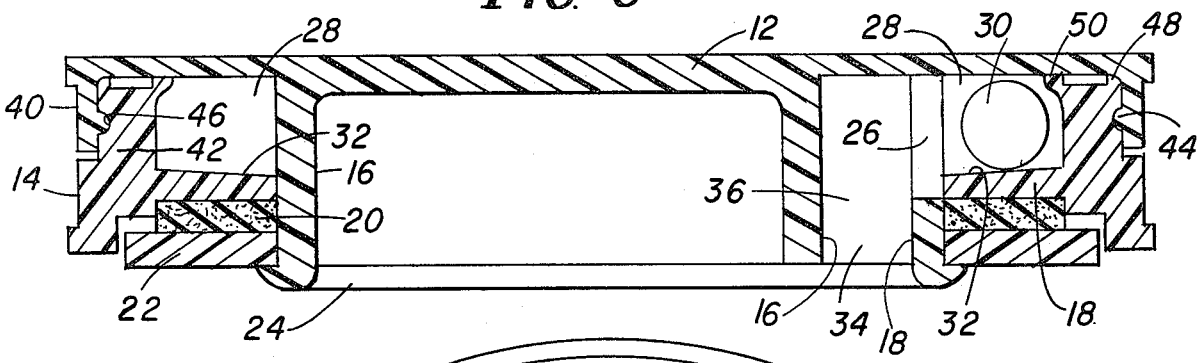
FIG. 6 is a cross-sectional view, taken generally along the line 6—6 of FIG. 2.

In the drawings, a pill dispenser incorporating the principles of the present invention is indicated by the reference character 10. The pill dispenser 10 includes a cover or top member 12 in the form of a disc and a bottom ring member or annularly shaped container 14.

The top member 12 is preferably formed of a substantially transparent material having a flexural modulus to allow sufficient snap-action for assembly and sealing. Top member 12 overlaps the bottom member 14. Although no limitation is intended, top member 12 may be formed of an acrylic resin.

A depending axially extending annular hub or ring 16 is formed on member 12 at a position spaced radially inwardly from the outer periphery of the top member and the hub 16 engages the inner periphery of an annular wall 18 of bottom member 14. Hub 16 extends through wall 18 and through a ring-shaped compressive member in the form of a foam pressure pad 20. Pressure pad 20 is sandwiched against the lower surface of wall 18 by a retaining ring 22 secured to wall 18 by means of a lip 24 formed at the axial end of hub 16.

Member 14 is preferably formed of a rigid or semi-rigid material and the ring-shaped pad 20 is preferably formed of a closed cell polyethylene or other thermoplastic foam material. The lip 24 may be formed by spin welding to permit limited axial movement of the members 12 and 14 against the pressure of pad 20 and also permit rotational movement.

Figure 7:
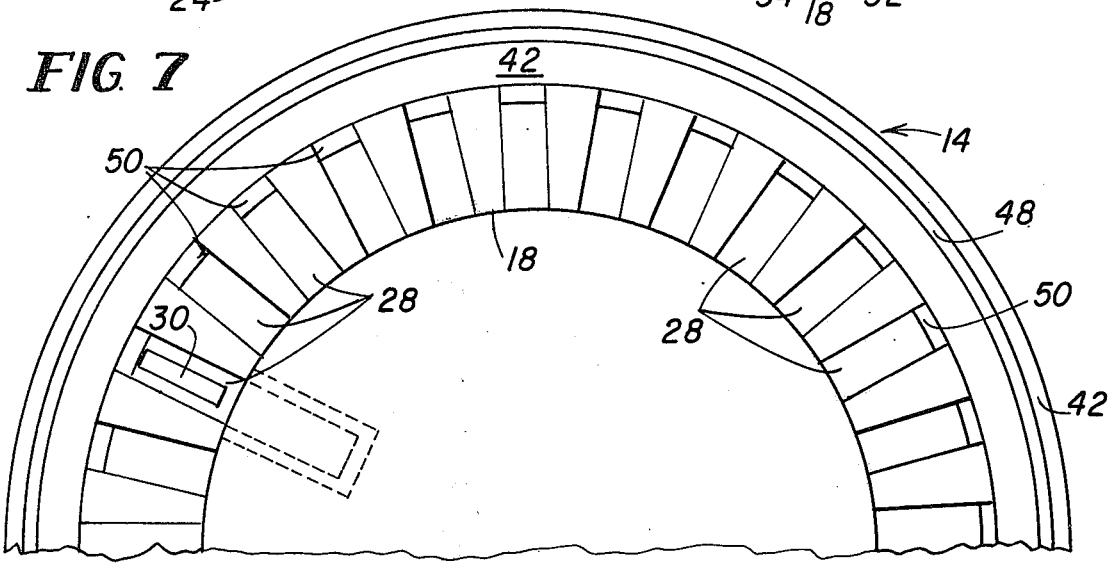
FIG. 7 is an enlarged top view of a portion of the container.
Figure 8:
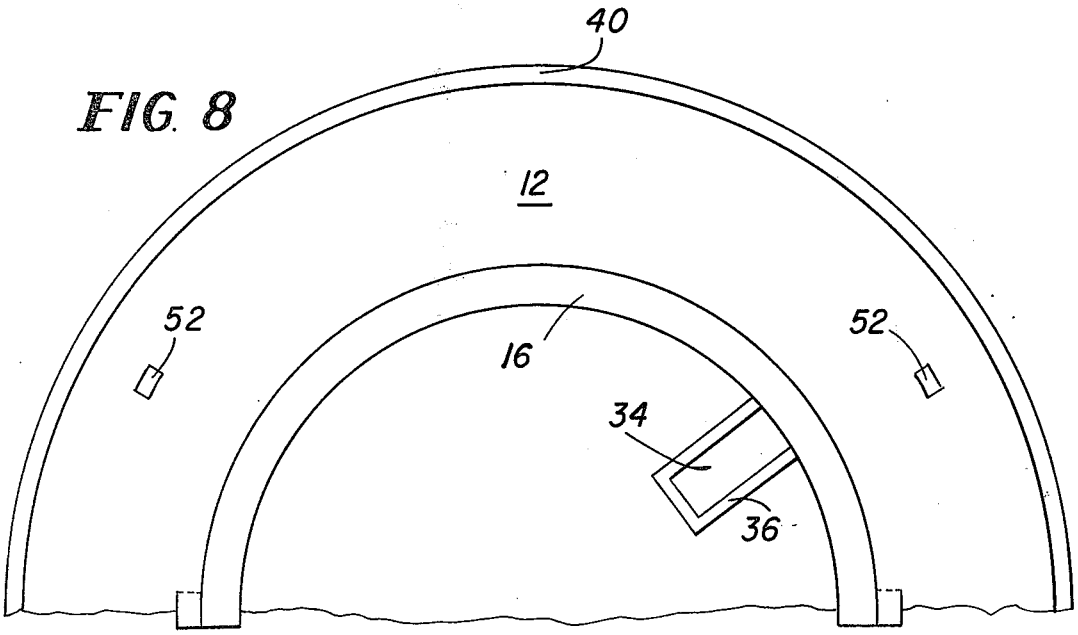
FIG. 8 is an enlarged bottom view of a portion of the cover.
Figure 9:
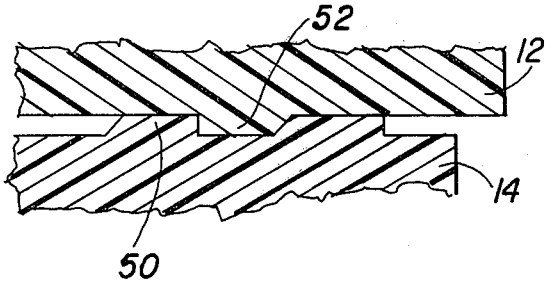
FIG. 9 is an enlarged fragmentary view of the engaged teeth.

A slot or passage 26 is provided in the hub 16 for rotatable alignment with each of a series or pockets or recesses 28 formed in the top surface of the wall 18, as best seen in FIGS. 1, 6 and 7. Each pocket 28 has side walls and contains or carries a respective generally disc-shaped pill 30 with the circular periphery of each pill resting upon a top oblique surface 32 of the respective pocket 28, as best seen in FIG. 6. The surface 32 is sloped in the direction of the axis of the members 12 and 14. This permits each pill 30 to easily roll or slide from the respective pocket 28 through slot 26, and from the passage 34 defined by the inner periphery of hub 16, wall 18, pad 20 and ring 22 into the user's hand. Movement of the pill may be initiated by the effect of the sloped surface 32 or by slight tilting of the hands.

A pair of radially inwardly extending walls 36 interconnected at their radially inward end are provided on opposite sides of the slot 26 to confine and guide the movement of the pill toward the center of the user's hand. These form a passage 38 within the passage 34.

Member 12 has a second axially extending wall 40 located adjacent the scalloped outer periphery of the disc member 12 for nestingly receiving an annular wall 42 of member 14 at the outer periphery of wall 18 and which forms the back wall of the pockets 28. Two spaced bearing surfaces are thus provided for members 12 and 14. A peripheral bead 44 on the inner surface of wall 40 snap-fittingly engages a peripheral recess 46 in the outer periphery of wall 42 to provide a secondary seal between the members 12 and 14. A primary peripheral chevron seal 48 is formed at the top outer peripheral corner of wall 42 by means of an undercut. Seal 48 engages the corner between wall 44 and the disc portion of member 12 under pressure of lip 24 and the foam pad 20.

The top axial end of wall 42 is also provided with a series of buttress teeth 50 adjacent the inner periphery of wall 42 for engagement with a buttress tooth such as 52 depending from the bottom surface of the top cover member 12 to normally prevent relative rotatable movement between the top member 12 and bottom members 14. The number of teeth 50 and 52 may, of course, be selected as desired, it only being necessary that at least one tooth be provided on one member for sequential engagement with a series of teeth on the other member and that the teeth be positioned to permit the slot 26 to register with each pocket in sequence. The teeth 50 and 52 thus also serve to index the rotation of the cover relative the container. Wall 42 extends below wall 18 and is provided with a stepped inner periphery for positioning the pad 20 and the retaining ring 22. The outer periphery of wall 42 is also stepped outwardly below wall 40 to provide periphery generally coincident with wall 40. The lower portion of wall 42 is scalloped, milled or knurled or otherwise textured to provide a gripping area.

To assemble pill dispenser 10, pad 20 (which acts as a spring) and retaining ring or plate 22 are assembled to the bottom member 14. Bottom member 14 is then positioned to permit the pills 30 to be stacked on their peripheries in the respective pockets 28. Top member 12 is then assembled to bottom member 14 with the bead 44 snap-fitting into recess 46 of wall 42. Slot 26 is aligned with a blank position which has been provided in wall 18 by omitting a pocket 28 in that portion of the wall. Lip 24 is then formed by pressure and heat or spin welding to bear against the ring 22. The chevron seal 48 together with teeth 50 and 52 are placed under axial pressure by pad 20 to provide effective sealing and prevent relative rotatable movement. Member 12 or member 14 (since member 12 is transparent) bear suitable indicia including such calendar information as needed to permit the user to properly operate the dispenser 10.

Figure 10:
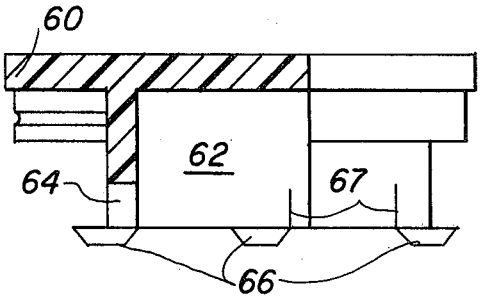
FIG. 10 illustrates another form for the cover, in partial section.

In FIG. 10, an alternative embodiment of the top member is indicated by the reference character 60. Member 60 is similar to member 12 except that hub 62 has axially extending slits or slots 64 therein and radially outwardly extending lips 66 formed at the axial end thereof. The lips 66 on hub 62 may thus be snap-fittingly engaged with plate 22, to retain the assembly. This avoids forming lip 24 and on insertion of hub 62 through wall 18 permits facile assembly of members 12 and 14.

Figure 11:
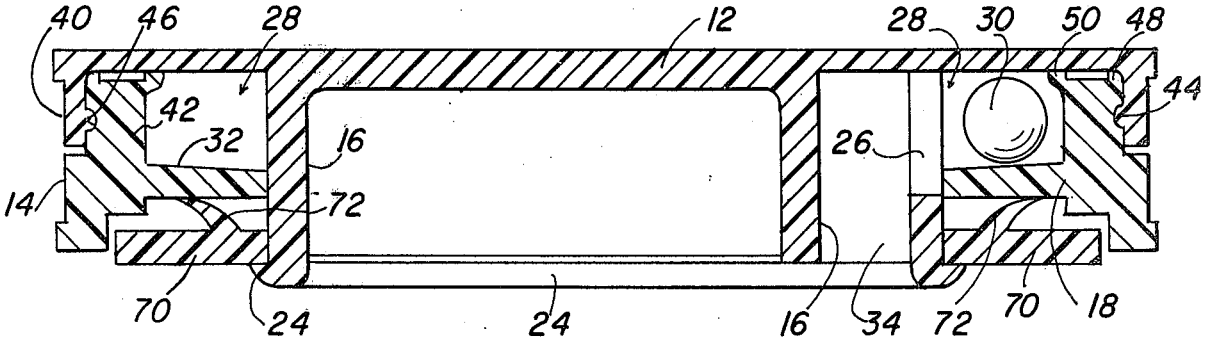
FIG. 11 is a cross-sectional view, similar to FIG. 6 but showing a modified form of compressive member.

An alternative embodiment of the compressive member 20 is illustrated in FIG. 11. In the alternative embodiment, the compressive member comprises a molded disc 70 carrying an integrally formed annular chevron seal 72. It can be seen that lip 24 sandwiches disc 70 and its resilient chevron seal 72 against member 14, permitting the pill dispenser of FIG. 11 to operate in the same manner as the pill dispenser illustrated in FIGS. 1–9.

The user, in order to extract a pill, engages the top member 12 with the fingers of one hand while the bottom member 14 is held in the fingers of the other hand, which naturally forms a cup beneath the passages 34 and 38. A pulling force is then extended to move the top and bottom members 12 and 14 in opposite axial directions for disengaging teeth 50 and 52. This pulling force effectively child-proofs the dispenser. With a slight relative rotational force imparted to the members 12 and 14, as soon as the teeth disengage, rotation occurs to move the slot 26 into alignment with a pocket 28 having a pill therein. Either directly or upon slight tilting of dispenser 10, the pill will roll or slide through slot 26 into the user's cupped hand for easy capture. Upon release of member 12 or 14, teeth 50 and 52 will reengage. Slot 26 is aligned with an empty pocket. Dispenser 10 is again, therefore, child-proofed. It is understood that various modifications and substitutions may be made by those skilled in the art without departing from the novel spirit and scope of the invention.

I claim:

1. A pill dispenser which comprises: a pair of relatively rotatable members for sequentially dispensing a different pill in response to the relative rotation of one member to each of a plurality of different angular positions relative to the other member; and means for normally preventing relative rotation between said members in both rotational directions and for enabling said relative rotational movement only in response to axial forces applied to said members in opposite axial directions, said means preventing rotation comprising a spring biasing said members toward each other, whereby axial forces applied to said members in opposite axial directions can overcome enough of said spring bias to enable relative rotational movement of said members.

2. The pill dispenser described in claim 1, in which the other member carries a plurality of pills and one of said members has at least one tooth engaging a tooth for each pill on the other member.

3. The pill dispenser described in claim 2, in which the teeth on one member are axially biased toward the other member.

4. The pill dispenser described in claim 2, in which the teeth are spaced to index the rotation of said one member relative the other member.

5. The pill dispenser described in claim 4 in which the teeth allow indexed rotation in response to the application of an axial force against said bias and a rotational force to said one member.

6. The improvement described in claim 1, including means for supporting the pills and means for guiding the dispensed pill centrally and downwardly to automatically direct the dispensed pill into the user's hand when the members are relatively rotated.

7. The improvement described in claim 1, in which one of said members carries a chevron seal.

8. The pill dispenser described in claim 7, in which said spring biases said chevron seal against the other of said members.

9. The pill dispenser described in claim 1, in which one of said members is a ring defining a plurality of recesses in one surface thereof, each recess being adapted to receive one of said pills, and the other of said members has a surface overlapping said one surface.

10. A pill dispenser carrying a plurality of pills, which comprises: a pair of relatively rotatable members for sequentially dispensing a different pill in response to the relative rotation of one member to each of a plurality of different angular positions relative to the other member; means for normally preventing relative rotation between said members in both rotational directions and for enabling said relative rotational movement only in response to axial forces applied to said members in opposite axial directions, said means preventing rotation comprising a spring biasing said members toward each other, whereby axial forces applied to said members in opposite axial directions can overcome enough of spring bias to enable relative rotational movement of said members; one of said members being a ring defining a plurality of recesses in one surface thereof, each recess being adapted to receive one of said pills, and the other of said members having a surface overlapping said one surface; each of said pills being disc-shaped and with the peripheral surface of each disc being supported on a surface underlying a respective recess.

11. A pill dispenser which comprises: a pair of relatively rotatable members for sequentially dispensing a different pill in response to the relative rotation of one member to each of a plurality of different angular positions relative to the other member; and means for normally preventing relative rotation between said members and for enabling said relative rotational movement in response to axial forces applied to said members in opposite axial directions, said means preventing rotation comprising a chevron seal biasing said members toward each other, whereby axial forces applied to said members in opposite axial directions can overcome enough of said chevron seal bias to enable relative rotational movement of said members.

12. A pill dispenser carrying a plurality of pills, which comprises: a pair of relatively rotatable members for sequentially dispensing a different pill in response to the relative rotation of one member to each of a plurality of different angular positions relative to the other member; means for normally preventing relative rotation between said members and for enabling said relative rotational movement in response to axial forces applied to said members in opposite axial directions, said means preventing rotation comprising a spring biasing said members toward each other, whereby axial forces applied to said members in opposite axial directions can overcome enough of said spring bias to enable relative rotational movement of said members; one of said members being a ring defining a plurality of recesses in one surface thereof, each recess being adapted to receive one of said pills, and the other of said members having a surface overlapping said one surface; each of said pills being disc-shaped and with the peripheral surface of each disc being supported on a surface underlying a respective recess, the bottom surface of each recess being inclined in the direction of the axis of said ring for enabling each pill to roll on said peripheral surface toward the axis of said ring, whereby the dispensed pill is automatically directed into the user's hand when the members are relatively rotated.

13. A pill dispenser which comprises: a pair of relatively rotatable members for sequentially dispensing a different pill in response to the relative rotation of one member to each of a plurality of different angular positions relative to the other member; and means for normally preventing relative rotation between said members and for enabling said relative rotational movement in response to axial forces applied to said members in opposite axial directions, said means preventing rotation comprising a spring formed of a foam material and biasing said members toward each other, whereby axial forces applied to said members in opposite axial directions can overcome enough of said spring bias to enable relative rotational movement of said members.

14. The pill dispenser described in claim 12, in which a passage is provided for each pill with said passage encircled by said ring member.

15. The pill dispenser described in claim 14, in which said other member has a hub engaging the inner surface of said ring member to prevent movement of each pill toward said axis, and a slot is defined by said hub for registration with each recess for enabling a pill in each recess to roll into said passage.

16. A pill dispenser which comprises: a cover member having a central opening; a ring-shaped container having a central opening, said container including means for holding a plurality of pockets open toward said central opening; a hub carried by said cover member, said hub defining a pill passage; means for coupling said cover member to said container with said hub closing said pockets to prevent dispensing of the pills except the pill in the pocket communicating with said pill passage; said pill passage being positioned to direct the dispensed pill centrally whereby it will be dispensed into the user's palm during relative rotation of the cover member and container.

17. A pill dispenser as described in claim 16, including means for normally preventing relative rotation between said cover member and said container and for enabling said relative rotation in response to an axial force applied to said cover member and container in opposite axial directions.

18. A pill dispenser as described in claim 17, in which said relative rotation preventing means comprises a tooth carried by one of said cover member and container, a plurality of teeth carried by said other of said cover member and container, and means for axially biasing said tooth toward said teeth.

19. A pill dispenser as described in claim 18, said biasing means comprising a spring formed of a compressible foam material in the shape of a ring.

20. A pill dispenser as described in claim 18, said biasing means comprising a spring which includes a chevron seal.

21. A pill dispenser as described in claim 16, including means or sealing said cover member and said container to prevent contamination.

22. A pill dispenser as described in claim 21, said sealing means comprising a chevron seal carried by one of said cover member and container; and means for biasing said chevron seal against the other one of said cover member and container.

23. A pill dispenser which comprises: a disc-shaped cover member having a central opening; a ring-shaped container having a central opening, said container including means for holding a plurality of pills, said holding means comprising a plurality of pockets open toward said central opening; a hub carried by said cover member, said hub defining a pill passage; means for coupling said cover member to said container with said hub closing said pockets to prevent dispensing of some pills but permitting dispensing of the pill in the pocket communicating with said pill passage; said pill passage being positioned to direct the dispensed pill centrally whereby it will be dispensed into the user's palm during relative rotation of the cover member and container; means for normally preventing relative rotation between said cover member and said container and for enabling said relative rotation in response to axial forces applied to said cover member and container in opposite axial directions, said relative rotation preventing means comprising a tooth carried by one of said cover member and container and a plurality of teeth carried by said other of said cover member and container; a compressible member for axially biasing said tooth toward said teeth; means for sealing said cover member and said container to prevent contamination, said sealing means comprising a chevron seal carried by one of said cover member and container, with said compressible member aiding in biasing said chevron seal against the other one of said cover member and container.

* * * * *